US007339451B2

(12) United States Patent
Liu et al.

(10) Patent No.: US 7,339,451 B2
(45) Date of Patent: Mar. 4, 2008

(54) INDUCTOR

(75) Inventors: Chun-Tiao Liu, Hsinchu (TW); Stanely Chen, Miaoli County (TW); Roger Hsieh, Hsinchu County (TW); Yimin Huang, Hsinchu (TW); Wei-Ching Chuang, Shuan-Hsin Iayi (TW)

(73) Assignee: Cyntec Co., Ltd., Hsinchu (TW)

( * ) Notice: Subject to any disclaimer, the term of this patent is extended or adjusted under 35 U.S.C. 154(b) by 65 days.

(21) Appl. No.: 10/937,465

(22) Filed: Sep. 8, 2004

(65) Prior Publication Data

US 2006/0049906 A1 Mar. 9, 2006

(51) Int. Cl.
*H01F 5/00* (2006.01)

(52) U.S. Cl. ..... 336/200

(58) Field of Classification Search ..... 336/65, 336/83, 192, 200, 233
See application file for complete search history.

(56) References Cited

U.S. PATENT DOCUMENTS

| | | | | |
|---|---|---|---|---|
| 6,882,261 | B2 * | 4/2005 | Moro et al. | 336/200 |
| 7,034,645 | B2 * | 4/2006 | Shafer et al. | 336/83 |
| 2004/0209120 | A1 * | 10/2004 | Inoue et al. | 428/694 B |

* cited by examiner

*Primary Examiner*—Tuyen T. Nguyen
(74) *Attorney, Agent, or Firm*—Steve Mendelsohn

(57) ABSTRACT

This invention discloses an inductor including a conducting wire having a winding configuration provided for enclosure in a substantially rectangular box with a mid-plane extended along an elongated direction of the rectangular box wherein the conducting wire intersecting at least twice near said mid-plane.

18 Claims, 11 Drawing Sheets

INDUCTOR

BACKGROUND OF THE INVENTION

1. Field of the Invention

This invention relates generally to the device configuration and processes for manufacturing inductor coils. More particularly, this invention relates to an improved configuration and process for manufacturing compact and high current inductor coils.

2. Description of the Prior Art

For those of ordinary skill in the art, the configurations and the process of manufacturing a high current inductor coil are still faced with technical challenges that inductor coils manufactured with current technology still do not provide sufficiently compact form factors often required by applications in modern electronic devices. Furthermore, conventional inductor coils are still manufactured with complicated manufacturing processes that involve multiple steps of epoxy bonding and wire welding processes.

Shafer et al. disclose a high current low profile inductor in U.S. Pat. No. 6,204,744, as that shown in FIG. 1. The inductor disclosed by Shafer et al. includes a wire coil having an inner coil end and an outer coil end. A magnetic material completely surrounds the wire coil to form an inductor body. First and second leads connected to the inner coil end and the outer coil end respectively extend through the magnetic material to the exterior of the inductor body. As shown in FIG. 1, the inductor coil 10 is mounted on a circuit board 12. The inductor coil 10 includes an inductor body 14 that has a first lead 16 and a second lead 18 extending outwardly from the coil 10. The leads 16 and 18 are bent and folded under the bottom of the inductor body 14 and are shown soldered to a first pad and a second pad 20, 22 respectively. As shown in FIG. 1B, the inductor 10 is constructed by forming a wire coil 24 from a flat wire having a rectangular cross section. By forming the wire into a helical coil, the coil 24 includes a plurality of turns 30 and also includes an inner end 26 and an outer end 28. A lead frame 32 includes a first lead 16, which has one end 34 welded to the inner end 26 of the coil 24. The lead frame also includes a second lead 18 which has one end 38 welded to the outer end 28 of coil 24. The leads 16 and 18 include free ends 36, 40, which are attached to the lead frame 32. A resist welding process is applied to weld ends 34, 38 to the inner end 26 and the outer end 28 of coil 24.

The inductor coil as shown in FIGS. 1A and 1B by Shafer et al. still have several limitations. Since the wire coil 24 is formed by flat wires that stand on a vertical direction, the height of the flat wire 24 becomes an inherent limitation to the form factor of the inductor coil. Further miniaturization of the inductor coil becomes much more difficult with a vertical standing flat wire as shown in FIG. 1B. The production cost is also increased due to the requirements that the lead frame and the coil must be separately manufactured. The manufacture processes are further complicated since several welding and bonding steps are required to securely attach the welding ends of the flat wire to the welding points of the lead frame. The production yields and time required to manufacture the inductor coil are adversely affected due to the more complicated inductor configurations and multiple bonding and welding manufacturing processes.

Japanese Patent Applications 2003-229311 and 2003-309024 disclose two different coil inductors constructed as a conductor rolled up as an inductor coil. These inductors however have a difficulty that the inductor reliability is often a problem. Additionally, the manufacturing methods are more complicated and the production costs are high. The high production costs are caused by the reasons that the configurations are not convenient for using automated processes. Thus, the inductors as disclosed do not enable a person of ordinary skill to perform effective cost reduction in producing large amounts of inductors as now required in wireless communications.

Therefore, a need still exists in the art of design and manufacture of inductors to provide a novel and improved device configuration and manufacture processes to resolve the difficulties. It is desirable that the improved inductor configuration and manufacturing method can be simplified to achieve lower production costs and high production yield while providing inductors that are more compact with lower profiles such that the inductors can be conveniently integrated into miniaturized electronic devices. It is further desirable the new and improved inductor and manufacture method can improve the production yield with simplified configuration and manufacturing processes.

SUMMARY OF THE PRESENT INVENTION

It is therefore an object of the present invention to provide a new structural configuration and manufacture method for manufacturing an inductor with simplified manufacturing processes to produce inductors with improved form factors having smaller height and size and greater device reliability.

Specifically, this invention discloses an inductor that includes conducting wire-winding configurations that are more compatible with automated manufacturing processes for effectively reducing the production costs. Furthermore, with enhanced automated manufacturing processes, the reliability of the inductors is significantly improved.

Briefly, in a preferred embodiment, the present invention includes a conducting wire having a winding configuration provided for enclosure in a substantially rectangular box. The conducting wire is molded in a magnetic bonding material comprises powdered particles with a diameter smaller than ten micrometers and coated with an insulation layer.

This invention discloses a method for manufacturing an inductor. The method includes a step of winding a conducting wire. The method further includes a step of molding the conducting wire in a magnetic bonding material comprising powdered particles with a diameter smaller than ten micrometers and coated with an insulation layer.

These and other objects and advantages of the present invention will no doubt become obvious to those of ordinary skill in the art after having read the following detailed description of the preferred embodiment which is illustrated in the various drawing figures.

DETAILED DESCRIPTION OF THE PREFERRED EMBODIMENT

Figure 1A:
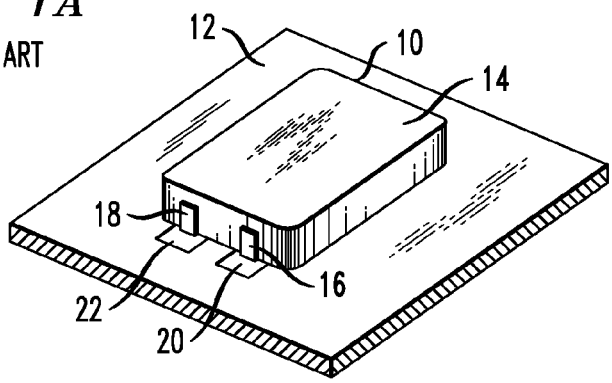
FIG. 1A PRIOR ART
FIGS. 1A to 1C are perspective views of a prior art inductor formed according to conventional manufacturing processes.
Figure 1B:
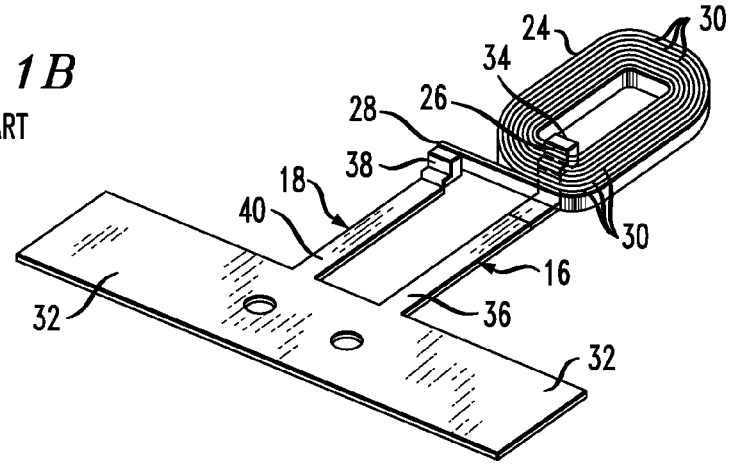
FIG. 1B PRIOR ART
Figure 1C:
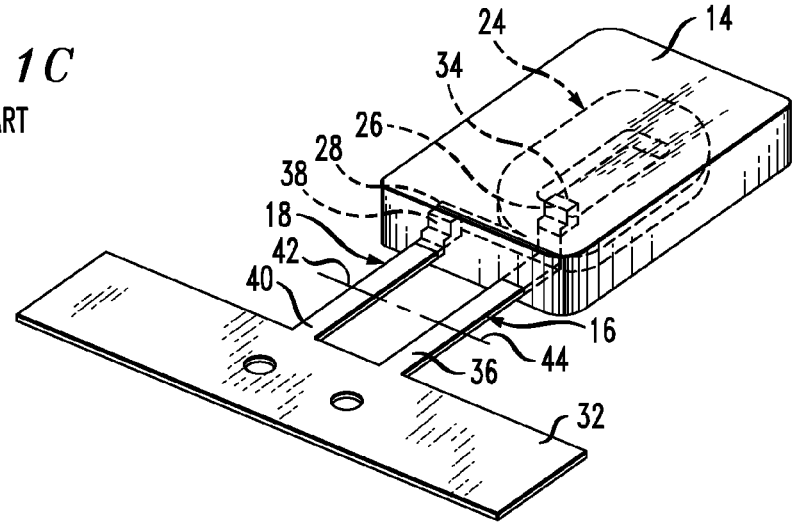
FIG. 1C PRIOR ART
Figure 2A:
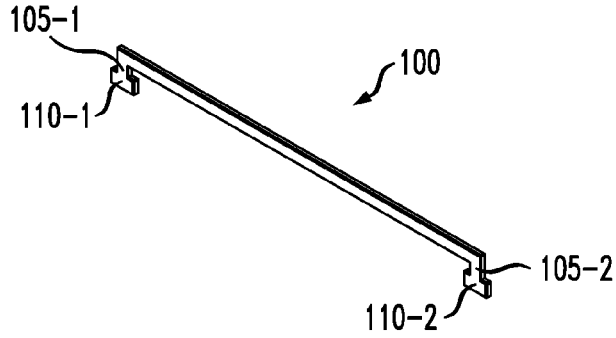
FIGS. 2A to 2D are a series of perspective views for showing the manufacturing processes to form an inductor of this invention.
Figure 2B:
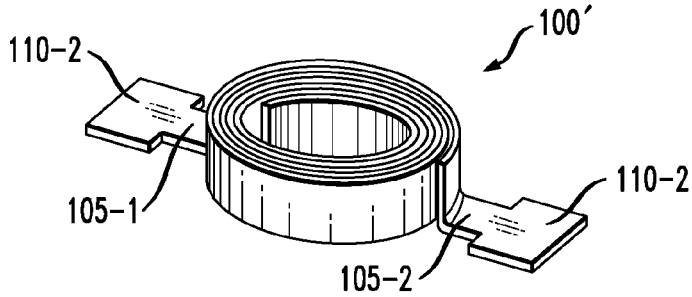

Referring to FIGS. 2A to 2D, a series of perspective views illustrate manufacturing processes of this invention. In FIG. 2A, a conductive flat wire 100 includes a first terminal extension 105-1 extended from a first end of the flat wire 100 connected to a first terminal plate 110-1. The flat wire 100 further has a second terminal extension 105-2 extended from a second end of the flat wire 100 and connected to a second terminal plate 110-2. In FIG. 2B, the flat wire 100 is rolled up as a coil 100' and the terminal extensions 105-1 and 105-2 are bent to extend away from the first and second ends of the rolled up coil 100'. The configuration has an advantage that the manufacturing processes are simplified because the flat wire 110 and terminal plates 110-1 and 110-2 can be formed by simply applying a metal pressing process. The coil further has an easily manageable form factor with a controllable outside diameter. The manufacturing processes are also simplified without requiring an electrode welding processing step, thus enhancing the automation of the manufacturing processes to effectively reduce the production costs.

Specifically, the flat wire 100 and the terminal extension have a rectangular cross section. An example of a preferred wire for coil 100 is an enameled copper flat wire manufactured by H.P. Reid Company, Inc., that is commercially available. The wire 100 and the extensions 105-1 and 105-2 are made from OFHC Copper 102, 99.95% pure. A polymide enamel, class 220, coats the wire for insulation. An adhesive, epoxy coat bound "E" is coated over the insulation. The wire is formed into a helical coil, and the epoxy adhesive is actuated by either heating the coil or by dropping acetone on the coil. Activation of the adhesive causes the coil to remain in its helical configuration without loosening or unwinding. The terminal plates 110-1 and 110-2 are not covered by the insulation coating and thus are ready to provide electrical contacts to the external circuits. As shown in FIG. 2B, the terminal extension 105-2 is extended from an outer end and the terminal extension 105-1 is extended from an inner end by crossing over the bottom of the coil 100'. The terminal plates 110-1 and 110-2 are extended away from the coil 100' and exposed without being covered by an insulation coating for ready connection to external electrical circuits.

Figure 2C:
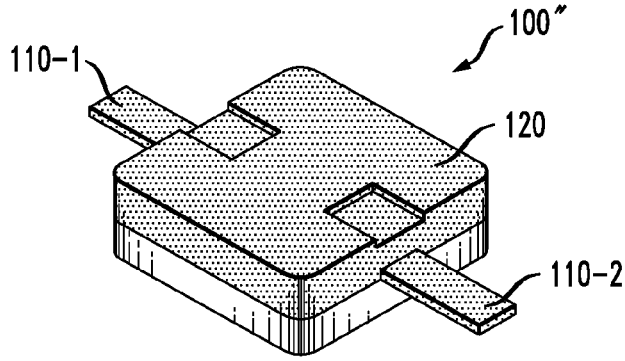
Figure 2D:
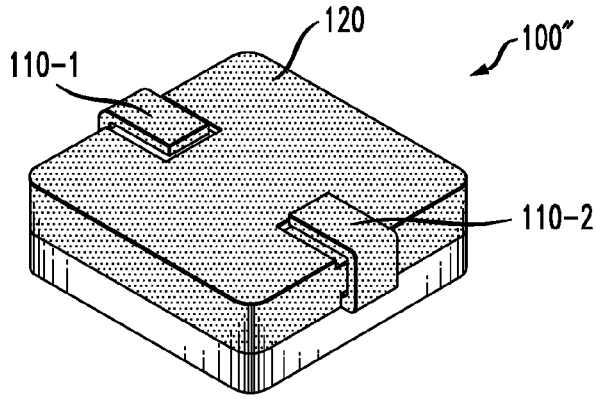

A powdered molding material (not shown) that is a highly magnetic material is poured into the coil 100' in such a manner as to completely surround the coil 100'. As shown in FIG. 2C, the coil molded with powdered material is enclosed in a box 120 with a part of the terminal extensions 105-1 and 105-2 and the terminal plates 110-1 and 110-2 extended out from the box. In FIG. 2D, the terminal plates 110-1 and 110-2 are folded onto the box to form a surface mounting inductive coil module. The inductor enclosure housing 120 is employed to contain the inductor coil 100' and to contain a powered magnetic molding material completely surrounding the inductor coil 100'. The magnetic molding material is employed to increase the effectiveness of the inductor. Various magnetic molding materials may be employed. Details of different preferred magnetic molding materials and methods for pressure molding and bonding to the enclosure housing 140 may be found in U.S. Pat. Nos. 6,204,744. 6,204,744 is hereby incorporated by reference in this Patent Application.

Figures 1, 3A:
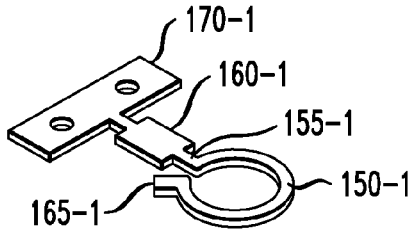
FIGS. 3A to 3D are a series of perspective views for showing the manufacturing processes to form another inductor of this invention.
Figures 2, 3A:
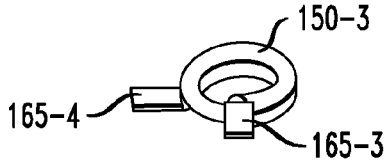
Figures 3, 3A:
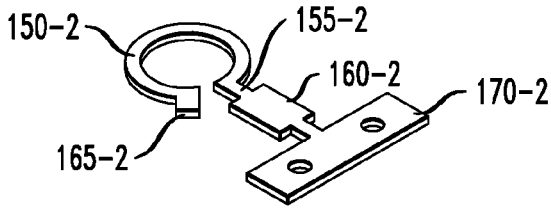
Figure 3B:
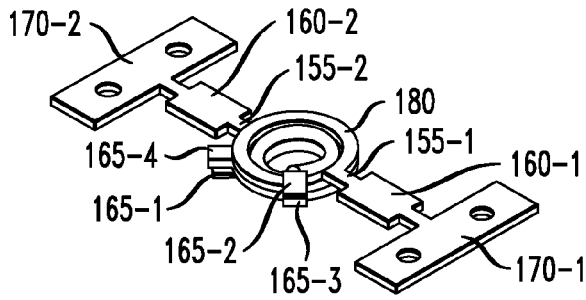

Referring to FIGS. 3A to 3D, a series of perspective views illustrate manufacturing processes of this invention. FIG. 3A-1 shows a conductive metal plate that is punched into a bottom piece having a first circular wire 150-1 connected to a first terminal extension 155-1 extending to a first terminal plate 160-1 supported on a first lead frame 170-1. FIG. 3A-2 shows a metal plate that is pressed punched into a middle piece having a middle circular wire 150-3 and two connecting plates 165-3 and 165-4 at two ends. FIG. 3A-3 shows a metal plate that is press punched into a top piece having a second circular wire 150-2 connected to a second terminal extension 155-2 extending to a second terminal plate 160-2 supported on a second lead frame 170-2. In FIG. 3B, the welding plate 165-2 of the top piece is welded onto the welding plate 165-3. The welding plate 165-4 of the middle piece is welded onto the welding plate 165-1 of the bottom piece. Thus, in FIG. 3B, the bottom, the middle, and the top pieces are welded as an integrated coil 180.

Figure 3C:
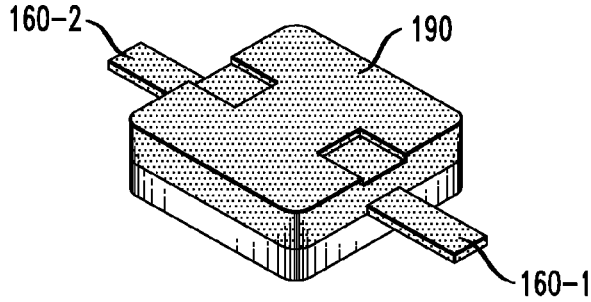
Figure 3D:
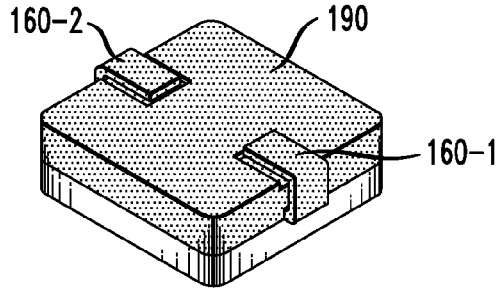

A highly magnetic powdered molding material (not shown) is poured into the inductive coil 180 in such a manner as to completely surround the coil 180. As shown in FIG. 3C, the coil molded with powdered material is enclosed in a box 190 with a part of the terminal extensions 155-1 and 155-2 and the terminal plates 160-1 and 160-2 extended out from the box. In FIG. 3D, the terminal plates 160-1 and 160-2 are folded onto the box to form a surface mounting inductive coil module.

Figures 1, 4A:
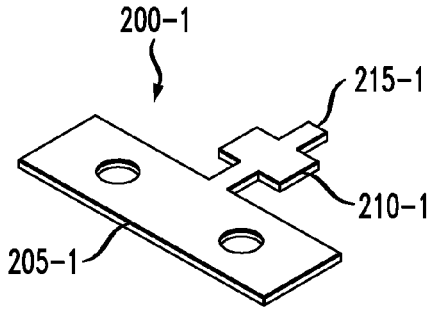
FIGS. 4A to 4G are a series of perspective views for showing the manufacturing processes to form another inductor of this invention.
Figures 2, 4A:
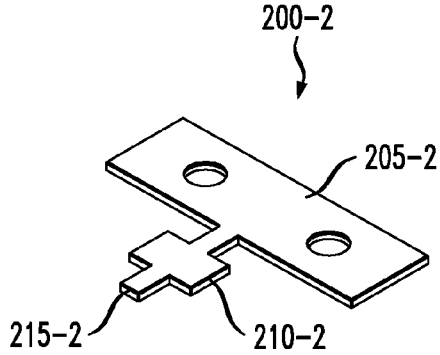
Figure 4B:
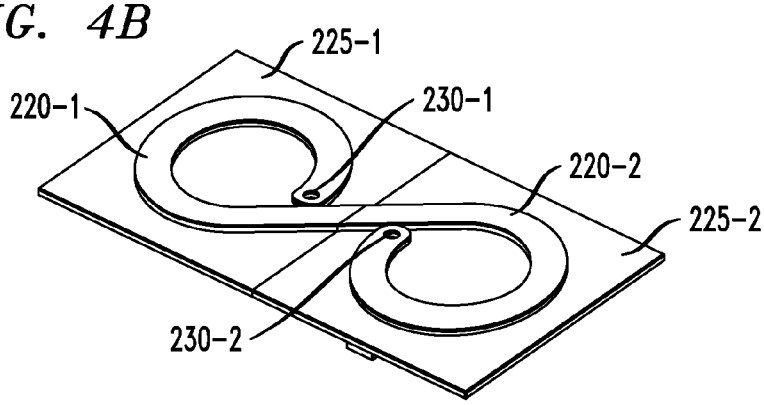
Figure 4C:
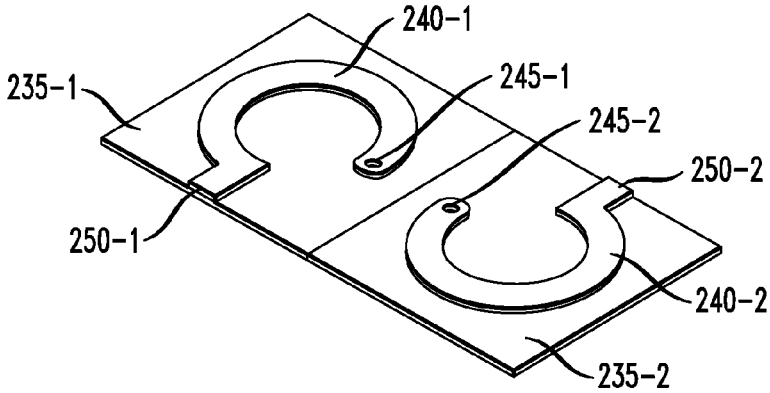
Figure 4D:
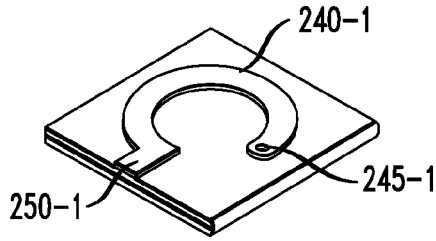
Figure 4E:
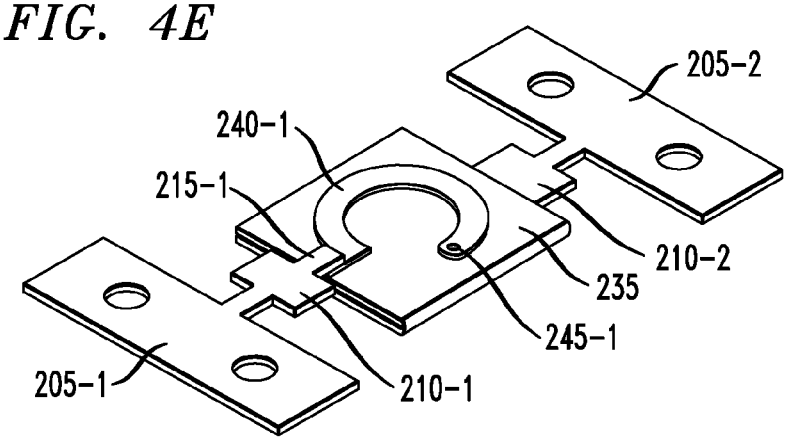

Referring to FIGS. 4A to 4G, a series of perspective views illustrate manufacturing processes of this invention. In FIGS. 4A-1 and 4A-2, two pieces of conductive plates are press-punched into first and second terminal connection frames 200-1 and 200-2 respectively. The first and second terminal connection frames 200-1 and 200-2 each include a base plate 205-1 and 205-2 with an extension connected to a terminal plate 210-1 and 210-2 with a welding extension 215-1 and 215-2. FIG. 4B shows an inner wire coil pair that includes a first circular wire 220-1 having a first welding end-point 230-1 and a second circular wire 220-2 having a second welding point 230-2 disposed on foldable printed circuit boards 225-1 and 225-2. FIG. 4C shows an outer wire coil pair that includes a first hook-shaped wire 240-1 having a first welding end-point 245-1 and a second hook-shaped wire 240-2 having a second welding end-point 245-2 disposed on foldable printed circuit boards 235-1 and 235-2. FIG. 4D shows a combined coil formed by folding the inner printed circuit boards 225-1 and 225-2 first and then folding the outer printed circuit boards 235-1 and 235-2 wrapping over the inner folded circuit boards. The outer folded PCB 235-1 is now placed on top of the folded inner PCB 225-1 with the first welding end point 245-1 welded to the first inner welding end point 230-1. The outer folded PCB 235-2 is now placed below the folded inner PCB 225-2 with the second welding end point 245-2 contacting and welded to the second inner welding end point 230-2. FIGS. 4E shows the terminal connection frames 200-1 and 200-2 welded onto the combined coil with the first welding end point 215-1 of the first terminal connection frame 200-1 welded onto the welding end point 250-1 and second welding end point 215-2 of the second terminal connection frame 200-2 welded onto the welding end point 250-2. The coil inductor as shown is disposed on a printed circuit board, simplifying both the design and the manufacturing processes.

Figure 4F:
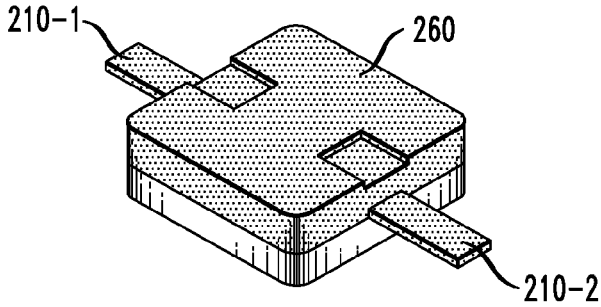
Figure 4G:
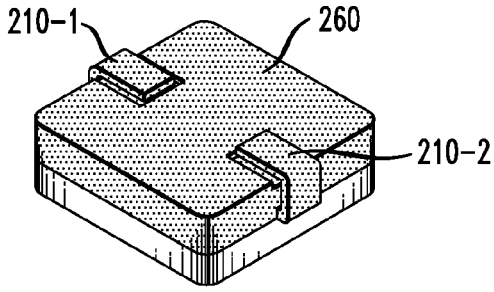

A highly magnetic powdered molding material (not shown) is poured into the combined inductive coil in such a manner as to completely surround the coil. As shown in FIG. 4F, the coil molded with powdered material is enclosed in a box 260 with a part of the terminal extensions and the terminal plates 210-1 and 210-2 extended out from the box. In FIG. 4G, the terminal plates 210-1 and 210-2 are folded onto the box 260 to form a surface mounting inductive coil module.

Figures 1, 5A:
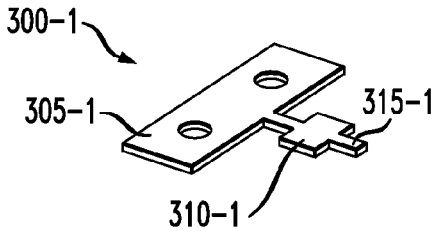
FIGS. 5A to 5F are a series of perspective views for showing the manufacturing processes to form another inductor of this invention.
Figures 2, 5A:
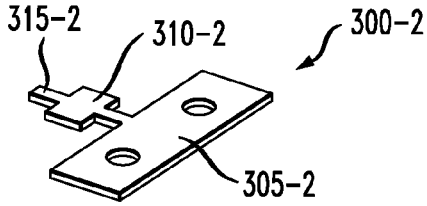
Figure 5B:
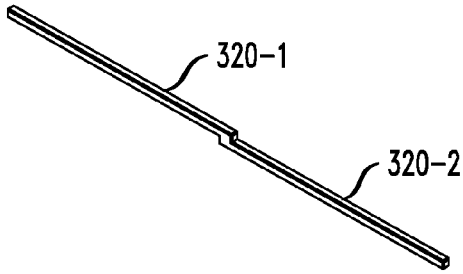
Figure 5C:
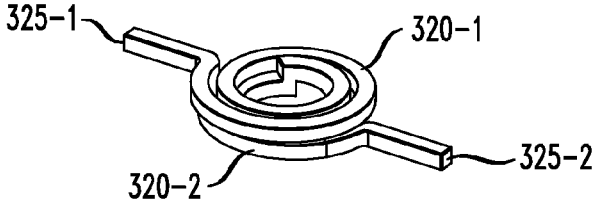
Figure 5D:
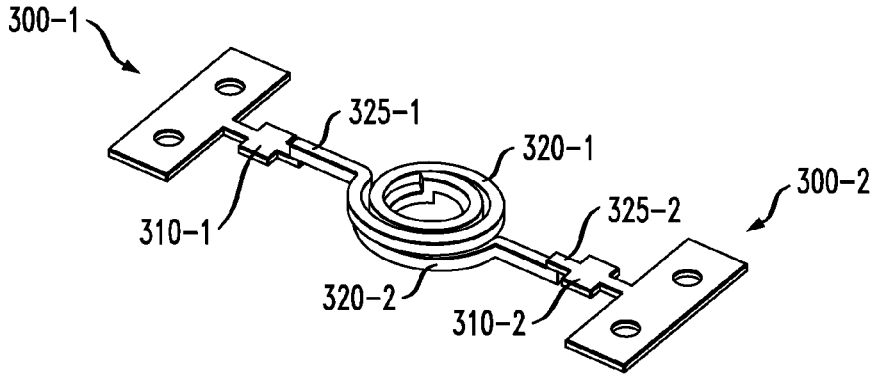

Referring to FIGS. 5A to 5F, a series of perspective views illustrate manufacturing processes of this invention. In FIGS. 5A-1 and 5A-2, two pieces of conductive plates are press-punched into first and second terminal connection frames 300-1 and 300-2 respectively. The first and second terminal connection frames 300-1 and 300-2 each include a base plate 305-1 and 305-2 with an extension connected to a terminal plate 310-1 and 310-2 with a welding extension 315-1 and 315-2. FIG. 5B shows a wire coil pair that includes a upper wire 320-1 connected to a lower wire 320-2. The wires 320-1 and 320-2 have a square shaped cross sectional area. In FIG. 5C, the upper wire 320-1 is rolled into an upper coil with an upper welding extension end 325-1. The lower wire 320-2 is rolled into a lower coil with a lower welding extension end 325-2. In FIG. 5D, the first terminal connection frame 300-1 is welded to the upper coil by welding together the welding points 315-1 to 325-1. The second terminal connection frame 300-2 is welded to the lower coil by welding together the welding points 315-2 to 325-2. The coil inductor as shown has a flat wire with large cross sectional area that further decreases the resistance and provides higher power utilization efficiency that becomes more important when batteries of limited capacity are utilized to drive the circuits of a mobile device.

Figure 5E:
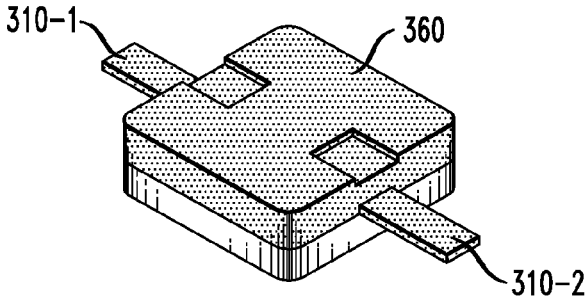
Figure 5F:
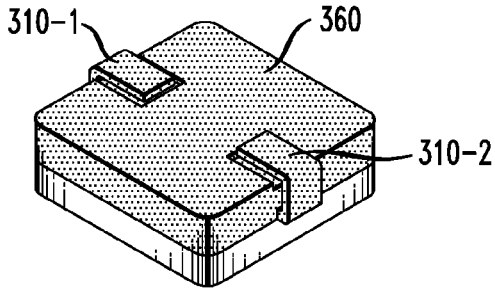

A highly magnetic powdered molding material (not shown) is poured into the combined inductive coil in such a manner as to completely surround the coil. As shown in FIG. 5E, the coil molded with powdered material is enclosed in a box 360 with a part of the terminal extensions and the terminal plates 310-1 and 310-2 extended out from the box. In FIG. 5F, the terminal plates 310-1 and 310-2 are folded onto the box 360 to form a surface mounting inductive coil module.

Figures 1, 6A:
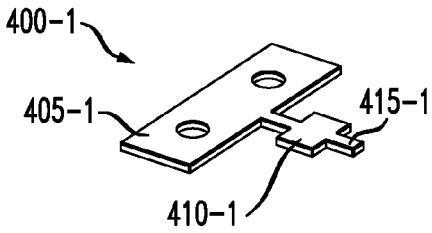
FIGS. 6A to 6G are a series of perspective views for showing the manufacturing processes to form another inductor of this invention.
Figures 2, 6A:
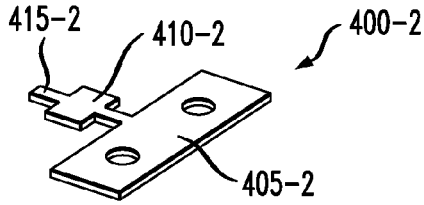
Figure 6B:
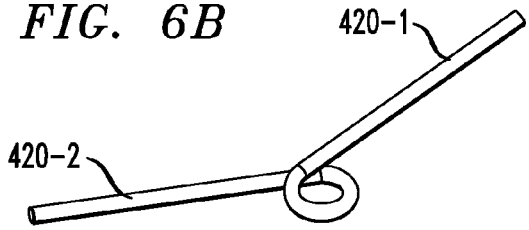
Figure 6C:
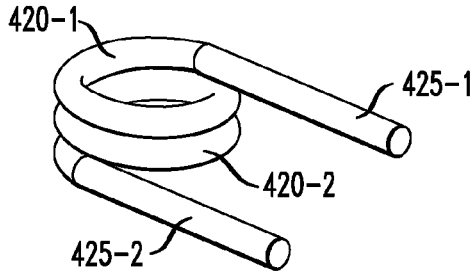
Figures 1, 6C:
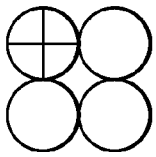
Figures 2, 6C:
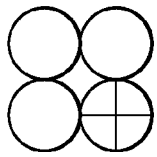
Figures 1, 6D:
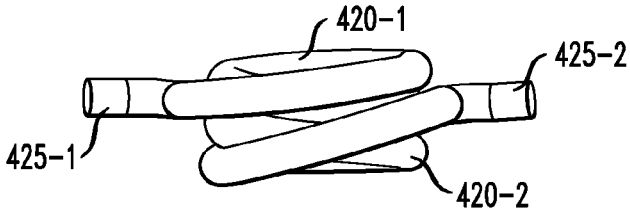
Figures 2, 6D:
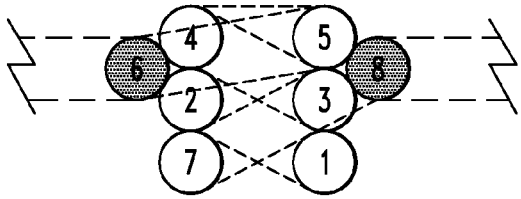
Figure 6E:
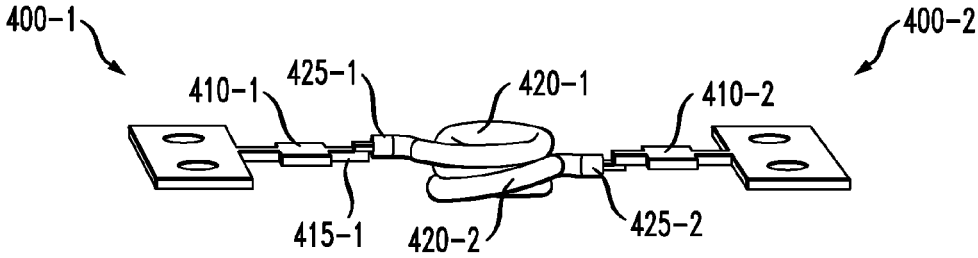

Referring to FIGS. 6A to 6F, a series of perspective views illustrate manufacturing processes of this invention. In FIGS. 6A-1 and 6A-2, two pieces of conductive plates are press-punched into first and second terminal connection frames 400-1 and 400-2 respectively. The first and second terminal connection frames 400-1 and 400-2 each includes a base plate 405-1 and 405-2 with an extension connected to a terminal plate 410-1 and 410-2 with a welding extension 415-1 and 415-2. FIG. 6B shows a flexible wire coil that includes a upper wire 420-1 connected to a lower wire 420-2, and, in FIG. 6C, the upper wire 420-1 is rolled into an upper coil with an upper welding extension end 425-1. The lower wire 420-2 is rolled into a lower coil with a lower welding extension end 425-2. In FIG. 6D-1, the upper and the lower welding extension ends 425-1 and 425-2 are bent to extend along two opposite horizontal directions. FIG. 6D-2 shows a cross-sectional view of the coil of FIG. 6D-1. In FIG. 6E, the first terminal connection frame 400-1 is welded to the upper coil by welding together the welding points 415-1 to 425-1. The second terminal connection frame 400-2 is welded to the lower coil by welding together the welding points 415-2 to 425-2. Instead of welding to the terminal plates, in an alternative preferred embodiment, the ends of the coil wire are pressed into the terminal plates. The coil inductor as configured in this preferred embodiment has the advantage that the winding configuration allows for very convenient automation processes to significantly reduce the production cost. The improved automated manufacturing processes further improve the reliability of inductors produced with such configuration.

Figure 6F:
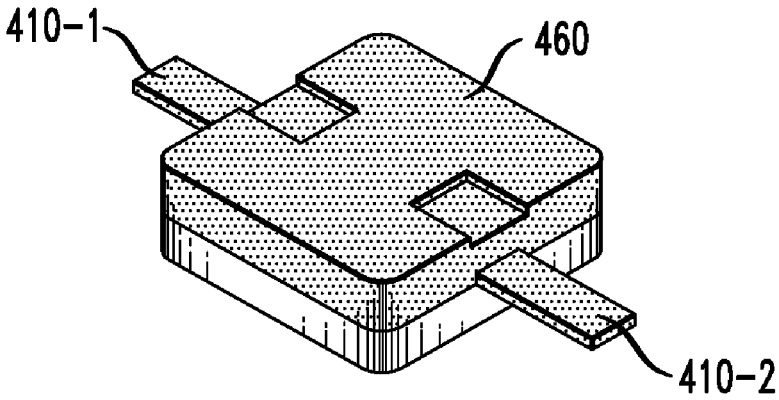
Figure 6G:
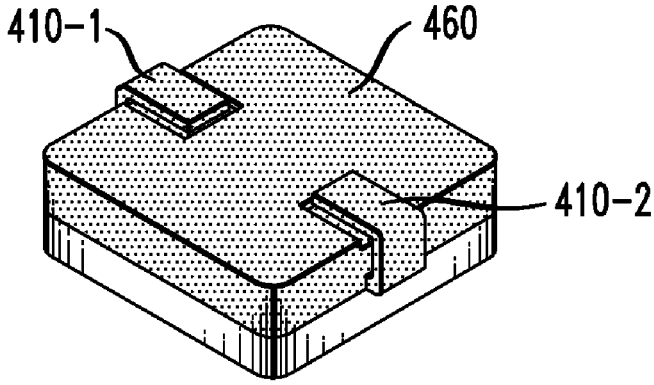

A highly magnetic powdered molding material (not shown) is poured into the combined inductive coil in such a manner as to completely surround the coil. As shown in FIG. 6F, the coil molded with powdered material is enclosed in a box 460 with a part of the terminal extensions and the terminal plates 410-1 and 410-2 extended out from the box. In FIG. 6G, the terminal plates 410-1 and 410-2 are folded onto the box 460 to form a surface mounting inductive coil module.

When compared to other inductive components, the inductor of the present invention has several unique attributes. The conductive winding and the leads are formed with a simplified structure thus having excellent connectivity and supreme reliability. The manufacturing processes for forming the conductive winding are much simplified. Furthermore, the conductive winding lead together with the magnetic core material and protective enclosure are molded as a single integral low profile unitized body that has termination leads suitable for surface mounting. The construction allows for maximum utilization of available space for magnetic performance and is self shielding magnetically.

The simplified manufacturing process of the present invention provides a low cost, high performance and highly reliable package. The simplified process with reduced welding requirements increases the production yields and reduces the production costs. The inductor is formed without the dependence on expensive, tight tolerance core materials and special winding techniques. The conductive coils as disclosed functioning as conductive windings of this invention allow for high current operation and optimize the magnetic parameters by using magnetic molding material for surrounding and bonding the conductive windings. By applying suitable magnetic bonding materials as the core material, it has high resistivity that exceeds three mega ohms that enables the inductor to carry out the inductive functions without a conductive path between the leads. The inductor can be connected to various circuits either by surface mounting or pin connections. Different magnetic materials allow the inductor to be used for applications in circuits operable at different level of frequencies. The inductor package performance according to this invention yields a low DC resistance to inductance ratio, e.g., 2 milli-Ohms per micro-Henry, that is well below a desirable ratio of 5 for those of ordinary skill in the art for inductor circuit designs and applications.

For the purpose of further improving the performance of the inductors, a special magnetic molding and bonding material is employed that includes carbonyle iron powder. The diameter of the powder particle is less then ten micrometers. The smaller the size of the particles, the smaller is the magnetic conductance of these particles and the greater is the saturation magnetization. For the purpose of optimizing the performance of the inductor, there must be a balance between these two parameters. In the present invention, a particle size with a diameter under 10 μm provides near optimal eddy current. As further discussed below, a greater eddy current improves the magnetic saturation current of the powdered particles when coated with an insulation layer. The powder particles are coated with an insulation layer comprising materials of polymer or sol gel. The resistances of these insulation coating materials are at least 1M ohms and preferably greater than 10M ohms. Such insulation coated particles have a special advantage that the inductor has greater saturation current. The inductor as disclosed in this invention when molded with powdered particles of magnetic material coated with the insulation layer can provide more stable operation when there are current fluctuations. The advantage is critically important for a system operated with larger currents. Additionally, with greater saturation current, the inductor of the present invention is able to provide better filtering performance and is able to store a larger amount of energy.

According to the above descriptions, this invention discloses an inductor that includes a conducting wire having a winding configuration provided for enclosure in a substantially rectangular box. The conducting wire is molded in a magnetic bonding material comprising powdered particles with a diameter smaller than ten micrometers and coated with an insulation layer. In a preferred embodiment, the powdered particles of the magnetic bonding material comprise carbonyle iron particles. In another preferred embodiment, the insulation layer comprises a layer with a resistance substantially greater than 1M ohms. In another preferred embodiment, the insulation layer comprises a layer with a resistance of about 10M ohms. In another preferred embodiment, the insulation layer comprises a polymer layer. In another preferred embodiment, the insulation layer comprises a sol gel layer. In another preferred embodiment, the conducting wire has a winding configuration provided for enclosure in a substantially rectangular box. In another preferred embodiment, the conducting wire has a winding configuration with a mid-plane extended along an elongated direction of the rectangular box wherein the conducting wire intersecting at least twice near the mid-plane is provided for enclosure in a substantially rectangular box. In another preferred embodiment, the conducting wire has a first flattened terminal end and a second flattened terminal end for extending out from an enclosure housing to function as first and second electrical terminals to connect to an external circuit. In another preferred embodiment, the conducting wire has a first welding terminal and a second welding terminal for extending out from an enclosure housing for welding to a lead frame.

Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alternations and modifications as fall within the true spirit and scope of the invention.

We claim:

1. An inductor comprising:

a coil formed from a conducting wire, the coil having (i) an upper side (e.g., 420-1 in FIG. 6D) and a lower side (e.g., 420-2) defining height of the coil and (ii) two radii of curvature being an outer radius of curvature and an inner radius of curvature, wherein the conducting wire comprises:

a first extension end (e.g., 425-1) located at the outer radius between the upper side and the lower side of the coil height;

a first coil portion connected to the first extension end and defining a first curved transition (i) from the outer radius to the inner radius and (ii) from the location between the upper and lower sides of the coil height to the lower side of the coil height;

a second coil portion connected to the first coil portion and defining, at the inner radius, a second curved transition from the lower side of the coil height to the upper side of the coil height;

a third coil portion connected to the second coil portion and defining a third curved transition (i) from the inner radius to the outer radius and (ii) from the upper side of the coil height to a location between the upper and lower sides of the coil height; and a second extension end (e.g., 425-2) connected to the third coil portion and located at the outer radius between the upper and lower sides of the coil height; and magnetic bonding material molded within and around the coil.

2. The inductor of claim 1, wherein the second coil portion has a substantially cylindrical shape.

3. The inductor of claim 1, wherein the first and second extension ends form electrical terminals for the inductor.

4. The inductor of claim 1, wherein the first and second extension ends are welded to electrical terminals for the inductor.

5. The inductor of claim 1, wherein the first and second extension ends have substantially identical locations between the upper and lower sides of the coil height.

6. The inductor of claim 1, wherein the first and second extension ends extend from the coil along substantially opposite horizontal directions.

7. The inductor of claim 1, wherein:

the first coil portion subtends approximately one-half turn of the coil; and the third coil portion subtends approximately one-half turn of the coil.

8. The inductor of claim 7, wherein the second coil portion subtends approximately two and one-half turns of the coil.

9. The inductor of claim 1, wherein the magnetic bonding material comprises powdered magnetic particles coated with an insulation layer.

10. The inductor of claim 9, wherein the powdered magnetic particles comprise carbonyle iron particles.

11. The inductor of claim 9, wherein the powdered magnetic particles have a diameter smaller than about ten micrometers.

12. The inductor of claim 9, wherein the insulation layer has a resistance greater than about 1M ohms.

13. The inductor of claim 12, wherein the insulation layer has a resistance greater than about 10M ohms.

14. The inductor of claim 9, wherein the insulation layer comprises a polymer.

15. The inductor of claim 9, wherein the insulation layer comprises a sol gel.

16. The inductor of claim 1, wherein:

the first coil portion radially overlaps at the outer radius a region of the second coil portion at the inner radius; and the third coil portion radially overlaps at the outer radius a different region of the second coil portion at the inner radius.

17. The inductor of claim 1, wherein a region of the first coil portion angularly overlaps a region of the third coil portion.

18. The inductor of claim 1, wherein:

the first and second extension ends (i) have substantially identical locations between the upper and lower sides of the coil height and (ii) extend from the coil along substantially opposite horizontal directions;

the first coil portion subtends approximately one-half turn of the coil;

the second coil portion has a substantially cylindrical shape and subtends approximately two and one-half turns of the coil;

the third coil portion subtends approximately one-half turn of the coil;

the first coil portion radially overlaps at the outer radius a region of the second coil portion at the inner radius;

the third coil portion radially overlaps at the outer radius a different region of the second coil portion at the inner radius;

a region of the first coil portion angularly overlaps a region of the third coil portion; and the magnetic bonding material comprises powdered carbonyle iron particles (i) having diameters smaller than about ten micrometers and (ii) coated with a polymer or sol gel insulation layer having a resistance greater than about 10M ohms.

* * * * *

UNITED STATES PATENT AND TRADEMARK OFFICE

CERTIFICATE OF CORRECTION

PATENT NO. : 7,339,451 B2
APPLICATION NO. : 10/937465
DATED : March 4, 2008
INVENTOR(S) : Chun-Tiao Liu et al.

It is certified that error appears in the above-identified patent and that said Letters Patent is hereby corrected as shown below:

Column 7, line 58, replace "(e.g., 425-1)" with --(e.g., 425-2)--.

Column 8, line 8, replace "(e.g., 425-2)" with --(e.g., 425-1)--.

Signed and Sealed this
Twenty-sixth Day of April, 2011

David J. Kappos

David J. Kappos
*Director of the United States Patent and Trademark Office*